US008168014B2

(12) United States Patent
Mori

(10) Patent No.: US 8,168,014 B2
(45) Date of Patent: May 1, 2012

(54) METHOD FOR MANUFACTURING MARTENSITIC STAINLESS STEEL PIPE OR TUBE

(75) Inventor: Nobuyuki Mori, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 212 days.

(21) Appl. No.: 12/593,677

(22) PCT Filed: Mar. 26, 2008

(86) PCT No.: PCT/JP2008/055644

§ 371 (c)(1),
(2), (4) Date: Apr. 6, 2010

(87) PCT Pub. No.: WO2008/123275

PCT Pub. Date: Oct. 16, 2008

(65) Prior Publication Data

US 2010/0193086 A1 Aug. 5, 2010

(30) Foreign Application Priority Data

Mar. 30, 2007 (JP) ..... 2007-092397

(51) Int. Cl.
*C21D 9/08* (2006.01)

(52) U.S. Cl. ..... 148/592; 148/607; 148/639; 148/644

(58) Field of Classification Search ..... 148/592, 148/593, 607, 608, 639, 644, 325, 327, 909
See application file for complete search history.

(56) References Cited

U.S. PATENT DOCUMENTS 6,090,230 A * 7/2000 Okamura et al. ..... 148/590

FOREIGN PATENT DOCUMENTS

| | | |
|---|---|---|
| JP | 54-31011 | 3/1979 |
| JP | 2002-38219 | 2/2002 |
| WO | 2005/035815 A1 | 4/2005 |

* cited by examiner

*Primary Examiner* — Deborah Yee
(74) *Attorney, Agent, or Firm* — Clark & Brody

(57) ABSTRACT

The method for manufacturing a martensitic stainless pipe includes heating the steel pipe until the external surface temperature thereof reaches a predetermined temperature not lower than A3 transformation point+20° C. and not higher than 980° C. The heated steel pipe is first water cooled until the external surface temperature thereof reaches a predetermined temperature not lower than 350° C. The water cooled steel pipe is air cooled until the external surface temperature thereof reaches a predetermined temperature not higher than 250° C. The air cooled steel pipe is either water or air cooled until the external surface temperature thereof reaches normal temperature. The cooling rate of the steel pipe in the first cooling step is determined according to the wall thickness of the steel pipe so that the amount of heat recuperation for the external surface temperature of the steel pipe in the second cooling step is not higher than 50° C.

1 Claim, 2 Drawing Sheets

FIG. 2

| | | NUMERICAL CALCULATION RESULT | | | | | ACTUALLY MEASURED VALUE | | | | | |
|---|---|---|---|---|---|---|---|---|---|---|---|---|
| TEST No. | STEEL PIPE WALL THICKNESS [mm] | HEAT TRANSFER COEFFICIENT [W/(m ·K)] | COOLING TIME [sec] | COOLING RATE [℃/sec] | EXTERNAL SURFACE TEMPERATURE [℃] | INTERNAL SURFACE TEMPERATURE [℃] | COOLING TIME [sec] | COOLING RATE [℃/sec] | EXTERNAL SURFACE TEMPERATURE [℃] | AMOUNT OF HEAT RECUPERATION [℃] | TOTAL COOLING TIME [sec] | EVALU-ATION |
| 1 | 5. 0 | 1000 | 12. 0 | 29. 2 | 500 | 544 | 12 | 30 | 490 | 18 | 520 | G |
| 2 | 5. 0 | 1250 | 9. 5 | 36. 8 | 500 | 555 | 10 | 36 | 495 | 25 | 523 | G |
| 3 | 5. 0 | 1500 | 7. 8 | 44. 9 | 500 | 565 | 8 | 44 | 502 | 33 | 585 | G |
| 4 | 5. 0 | 2000 | 5. 7 | 61. 4 | 500 | 588 | 6 | 59 | 496 | 47 | 615 | G |
| 5 | 10. 0 | 1000 | 20. 5 | 17. 1 | 500 | 578 | 21 | 16 | 516 | 40 | 1630 | G |
| 6 | 10. 0 | 1250 | 15. 9 | 22. 0 | 500 | 598 | 16 | 22 | 501 | 48 | 1670 | G |
| 7 | 10. 0 | 1500 | 12. 7 | 27. 6 | 500 | 619 | 13 | 26 | 512 | 64 | 1820 | NA |
| 8 | 10. 0 | 2000 | 8. 7 | 40. 2 | 500 | 660 | 9 | 37 | 515 | 77 | 1860 | NA |
| 9 | 15. 0 | 800 | 33. 5 | 10. 4 | 500 | 580 | 34 | 10 | 504 | 41 | 4920 | G |
| 10 | 15. 0 | 1000 | 25. 8 | 13. 6 | 500 | 600 | 26 | 14 | 495 | 47 | 5030 | G |
| 11 | 15. 0 | 1250 | 19. 6 | 17. 9 | 500 | 627 | 20 | 17 | 507 | 71 | 5650 | NA |
| 12 | 15. 0 | 1500 | 15. 5 | 22. 6 | 500 | 653 | 16 | 23 | 489 | 80 | 5680 | NA |
| 13 | 15. 0 | 2000 | 10. 0 | 35. 0 | 500 | 706 | 10 | 34 | 510 | 113 | 6350 | NA |

METHOD FOR MANUFACTURING MARTENSITIC STAINLESS STEEL PIPE OR TUBE

TECHNICAL FIELD

The present invention relates to a method for manufacturing a martensitic stainless steel pipe or tube. More particularly, the present invention relates to a method capable of manufacturing a martensitic stainless steel pipe or tube with high efficiency by reducing the time required for a heat treatment step. Hereinafter, "pipe or tube" is referred to as "pipe" when deemed appropriate.

BACKGROUND ART

Conventionally, a martensitic stainless steel pipe has been used widely for such applications as oil wells, and the like because it has high resistance to corrosion for $CO_2$. On the other hand, as for the martensitic stainless steel pipe, quenching cracks develop easily if cooling for quenching in the heat treatment step is all performed by water cooling, because the material thereof has extremely high hardenability. Therefore, to quench the martensitic stainless steel pipe in the heat treatment step, an air cooling method requiring many hours has generally been used, which reduces the manufacturing efficiency.

To eliminate the above-described disadvantage of poor manufacturing efficiency as one purpose, a method described in, for example, WO 2005/035815 (Patent Document 1) has been proposed. In the method described in Patent Document 1, a water cooling method having a high cooling rate and an air cooling method are combined in the temperature range excluding the vicinity of Ms point (a temperature at which martensitic transformation of steel starts in cooling at the quenching time).

Specifically, Patent Document 1 discloses a quenching method in which after being heated and austenitized, a steel pipe is cooled in the order of water cooling, air cooling, and water cooling. Specifically, Patent Document 1 discloses a technique for cooling the steel pipe from the external surface thereof in the water cooling step performed before air cooling so that the cooling rate in the range from 980° C. to point A (680° C. to 350° C.) is 1 to 40° C./sec. After the above-described water cooling step, air cooling is performed so that the cooling rate in the range from point A to point B (30 to 150° C.) is lower than 1° C./sec.

DISCLOSURE OF THE INVENTION

As described above, Patent Document 1 only discloses that the cooling rate of water cooling before air cooling is merely set within the range of 1 to 40° C./sec. To enhance the heat treatment efficiency as far as possible, it is generally thought that the cooling rate is increased (in Patent Document 1, 40° C./sec) so that the cooling time of water cooling before air cooling is shortest.

However, as the result of earnest studies, the present inventors found that in the case where the cooling method in which water cooling, air cooling, and water cooling are performed in that order is used in the heat treatment step in the manufacturing process of the martensitic stainless steel pipe, as the cooling rate of water cooling before air cooling is increased, the time required for cooling the steel pipe to a predetermined temperature in the subsequent air cooling step is prolonged, and consequently the total cooling time is prolonged. That is to say, it was found that if the cooling rate of water cooling before air cooling is made too high, the cooling time in this water cooling step is reduced, whereas the total cooling time is inversely prolonged.

The present invention has been made in view of the above-described prior art, and accordingly an object thereof is to provide a method capable of manufacturing a martensitic stainless steel pipe or tube with high efficiency by reducing the time required for cooling for quenching in a heat treatment step.

To solve the above-described problem, the present inventors carried out studies earnestly, and consequently obtained a knowledge of the following items (A) to (C) concerning the case where a cooling method in which water cooling, air cooling, and water cooling are performed in that order is used in the heat treatment step in the manufacturing process of the martensitic stainless steel pipe or tube.

(A) The fact that as the cooling rate of water cooling before air cooling is increased, the time required for cooling the steel pipe or tube to a predetermined temperature in the subsequent air cooling step is prolonged is influenced by heat recuperation caused by a difference in temperature between the internal and external surfaces of the steel pipe or tube immediately after the finish of water cooling (at the start of air cooling). The specific knowledge is as described below.

When the external surface of steel pipe or tube is water cooled, the internal surface temperature of steel pipe or tube immediately after the finish of water cooling is higher than the external surface temperature thereof. Therefore, at the early stage of transfer to air cooling, the heat on the internal surface and in the interior of steel pipe or tube is conducted toward the external surface, so that there occurs a phenomenon of heat recuperation that the external surface temperature of steel pipe or tube rises as compared with that immediately after the finish of water cooling. The amount of temperature rise due to the heat recuperation (the amount of heat recuperation) increases as the difference in temperature between the internal and external surfaces of the steel pipe or tube immediately after the finish of water cooling becomes larger. The larger the amount of heat recuperation is, the longer the time required for cooling the steel pipe or tube to the predetermined temperature by air cooling after water cooling is. Also, the difference in temperature between the internal and external surfaces of the steel pipe or tube immediately after the finish of water cooling becomes larger as the cooling rate of water cooling increases. Therefore, as the cooling rate of water cooling is increased (i.e. as water cooling is performed in a condition that the amount of heat recuperation at the stage of air cooling becomes large), the time required for cooling the steel pipe or tube to the predetermined temperature in the subsequent air cooling step is prolonged.

(B) The amount of heat recuperation as mentioned in the item (A) depends on not only the cooling rate of water cooling but also the wall thickness of steel pipe or tube. That is to say, as the wall thickness of steel pipe or tube becomes larger, the difference in temperature between the internal and external surfaces of the steel pipe or tube immediately after the finish of water cooling becomes larger, and therefore the amount of heat recuperation becomes larger.

(C) Since the cooling rate of water cooling is generally far higher than the cooling rate of air cooling, the cooling time of air cooling reduced by the reduction in amount of heat recuperation is far longer than the cooling time of water cooling reduced by the increase in the cooling rate of water cooling. Therefore, to reduce the cooling time at the quenching time (the time required for the whole of cooling step), it is essential that the cooling rate of water cooling be determined according to the wall thickness of steel pipe or tube so that the amount of heat recuperation is at a predetermined value or smaller.

The present inventor carried out further studies based on the above-described knowledge, consequently arrived at the idea that if the cooling rate of water cooling is determined so that the amount of heat recuperation is 50° C. or smaller, the cooling time required for the whole of cooling step at the quenching time can be reduced even if the cooling rate of air cooling performed after water cooling is set to a rate usually used, so that the heat treatment efficiency, and in turn, the manufacturing efficiency can be enhanced, and completed the present invention.

More specifically, the present invention provides a method for manufacturing a martensitic stainless steel pipe or tube, having a heat treatment step comprising: a heating step of heating the steel pipe or tube until the external surface temperature thereof reaches a predetermined temperature not lower than "A3 transformation point+20° C." and not higher than 980° C.; a first cooling step of water cooling the heated steel pipe or tube until the external surface temperature thereof reaches a predetermined temperature not lower than 350° C.; a second cooling step of air cooling the water cooled steel pipe or tube until the external surface temperature thereof reaches a predetermined temperature not higher than 250° C.; and a third cooling step of water cooling or air cooling the air cooled steel pipe or tube until the external surface temperature thereof reaches normal temperature, wherein the cooling rate of the steel pipe or tube in the first cooling step is determined according to the wall thickness of the steel pipe or tube so that the amount of heat recuperation for the external surface temperature of the steel pipe or tube in the second cooling step is not higher than 50° C.

In the present invention, "A3 transformation point" means a temperature at which the austenitic transformation of steel pipe or tube material is completed in the heating step. Also, "amount of heat recuperation for external surface temperature" means a difference between the highest external surface temperature of steel pipe or tube in a second cooling step and the external surface temperature of steel pipe or tube at the start of air cooling.

According to the method for manufacturing a martensitic stainless steel pipe or tube in accordance with the present invention, the time required for cooling in the heat treatment step, in particular, for quenching (the time required for performing first to third cooling steps) is reduced, and therefore the martensitic stainless steel pipe or tube can be manufactured efficiently.

BRIEF DESCRIPTION OF THE DRAWINGS

FIG. 1 (FIG. 1A and FIG. 1B) illustrate time changes of the external surface temperature of a steel pipe in the case where the manufacturing method in accordance with the present invention is applied. FIG. 2 is a table showing the results of a quenching test in accordance with examples of the present invention and numerical simulation.

BEST MODE FOR CARRYING OUT THE INVENTION

Figure 1A:
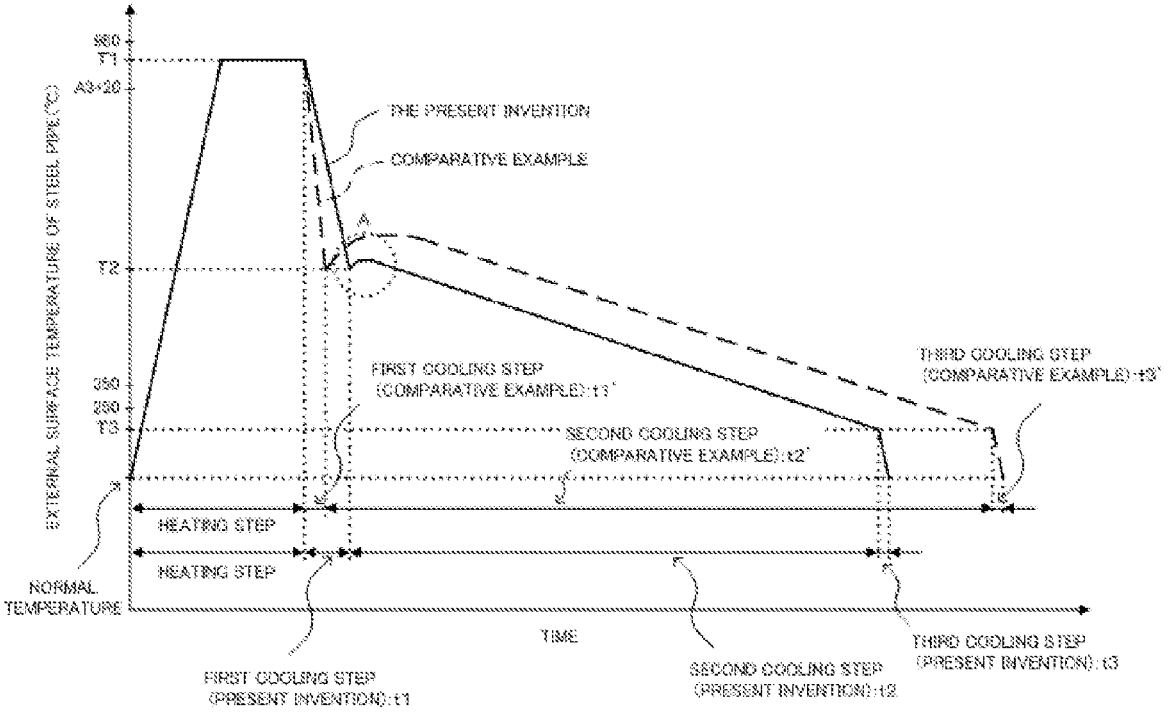
FIG. 1A is a graph showing a time change of the external surface temperature of a steel pipe.

One embodiment of a method for manufacturing a martensitic stainless steel pipe in accordance with the present invention will now be described with reference to the accompanying drawings.

First, the material of the martensitic stainless steel pipe to which the manufacturing method in accordance with the present invention is applied is explained.

(1) C: 0.15 to 0.20 Mass % (Hereinafter, Simply Described as "%")

C (carbon) is an element that is essential for obtaining a steel having proper strength and hardness. If the C content is less than 0.15%, a predetermined strength cannot be obtained. On the other hand, if the C content exceeds 0.20%, the strength becomes too high, and it becomes difficult to regulate the yield ratio and hardness. Also, an increase in amount of effective dissolved C makes delayed fracture liable to occur. Therefore, the C content is preferably in the range of 0.15 to 0.21%, more preferably in the range of 0.17 to 0.20%.

(2) Si: 0.05 to 1.0%

Si (silicon) is added as a deoxidizer for steel. To be effective, the Si content must be not less than 0.05%. On the other hand, if the Si content exceeds 1.0%, the toughness decreases. Therefore, the Si content is preferably in the range of 0.05 to 1.0%. The lower limit value of the content is more preferably 0.16%, and most preferably the lower limit value thereof is 0.20%. Also, the upper limit value of the content is more preferably 0.35%.

(3) Mn: 0.30 to 1.0%

Mn (manganese) has deoxidizing properties like silicon. If the Mn content is less than 0.30%, the effect is insufficient. Also, if the Mn content exceeds 1.0%, the toughness decreases. Therefore, the Mn content is preferably in the range of 0.30 to 1.0%. In view of securing toughness after heat treatment, the upper limit value of the content is more preferably set to 0.6%.

(4) Cr: 10.5 to 14.0%

Cr (chromium) is a basic component for providing corrosion resistance necessary for the steel. The Cr content not less than 10.5% improves the resistance to pitting and time-dependent corrosion, and remarkably increases the corrosion resistance in a $CO_2$ environment. On the other hand, since chromium is a ferrite forming element, if the Cr content exceeds 14.0%, δ ferrite is easily formed when processed at high temperatures, so that the hot workability is impaired. Also, the strength of steel after heat treatment is decreased. Therefore, the Cr content is preferably in the range of 10.5 to 14.0%.

(5) P: 0.020% or Less

A high content of P (phosphorus) decreases the toughness of steel. Therefore, the P content is preferably 0.020% or less.

(6) S: 0.0050% or Less

A high content of S (sulfur) decreases the toughness of steel. Also, sulfur produces segregation, so that the quality of internal surface of steel pipe is degraded. Therefore, the S content is preferably 0.0050% or less.

(7) Al: 0.10% or Less

Al (aluminum) exists in the steel as an impurity. If the Al content exceeds 0.10%, the toughness of steel decreases. Therefore, the Al content is preferably 0.10% or less, more preferably 0.05% or less.

(8) Mo: 2.0% or Less

If Mo (molybdenum) is added to the steel, the strength of steel is enhanced, and an effect of improving corrosion resistance is achieved. However, if the Mo content exceeds 2.0%, the martensitic transformation of steel becomes difficult to take place. Therefore, the Mo content is preferably 2.0% or less. Since molybdenum is an expensive alloying element, the content thereof is preferably as low as possible from the viewpoint of economy.

(9) V: 0.50% or Less

If V (vanadium) is added to the steel, an effect of increasing the yield ratio of steel is achieved. However, if the V content exceeds 0.50%, the toughness of steel decreases. Therefore, the V content is preferably 0.50% or less. Since vanadium is an expensive alloying element, the content thereof is preferably 0.30% or less from the viewpoint of economy.

(10) Nb: 0.020% or Less

If Nb (niobium) is added to the steel, an effect of enhancing the strength of steel is achieved. However, if the Nb content exceeds 0.020%, the toughness of steel decreases. Therefore, the Nb content is preferably 0.020% or less. Since niobium is an expensive alloying element, the content thereof is preferably as low as possible from the viewpoint of economy.

(11) Ca: 0.0050% or Less

If the Ca (calcium) content exceeds 0.0050%, the inclusions in the steel increase, and the toughness of steel decreases. Therefore, the Ca content is preferably 0.0050% or less.

(12) N: 0.1000% or Less

If the N (nitrogen) content exceeds 0.1000%, the toughness of steel decreases. Therefore, the N content is preferably 0.1000% or less. In the case where the N content is high in this range, the amount of effective dissolved N content increases, which makes delayed fracture liable to occur. On the other hand, in the case where the N content is low, the efficiency of denitrifying step decreases, which results in hindrance to productivity. Therefore, the N content is preferably in the range of 0.0100 to 0.0500%.

(13) Ti, B, Ni

Ti (titanium), B (boron), and Ni (nickel) can be contained in the steel as small amounts of additives or impurities. However, if the Ni content exceeds 0.2%, the corrosion resistance of steel decreases. Therefore, the Ni content is preferably 0.2% or less.

(14) Fe and Unavoidable Impurities

The material for the martensitic stainless steel pipe manufactured in accordance with the present invention contains Fe (iron) and unavoidable impurities in addition to the components of the above items (1) to (13).

Next, the method for manufacturing the martensitic stainless steel pipe containing the above-described components in accordance with the present invention is explained. Steps other than the quenching step can be performed by using the publicly known methods. Therefore, in this description, only the quenching step is explained.

Figure 1B:
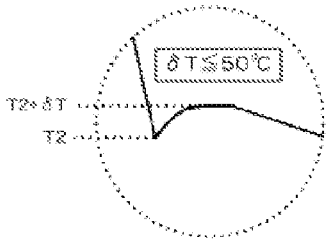
FIG. 1B is an enlarged view of region A shown in FIG. 1A.

FIG. 1 (FIG. 1A and FIG. 1B) illustrate time changes of the external surface temperature of a steel pipe in the case where the manufacturing method in accordance with the present invention is applied. FIG. 1A is a graph showing a time change of the external surface temperature of a steel pipe, and FIG. 1B is an enlarged view of region A shown in FIG. 1A. For convenience of description, FIG. 1A additionally shows a graph showing a time change of the external surface temperature of a steel pipe in the case where the manufacturing method in accordance with comparative example is applied. As shown in FIG. 1, the heat treatment step in the manufacturing method in accordance with the present invention includes a heating step, a first cooling step, a second cooling step, and a third cooling step to quench the steel pipe.

The heating step is a step in which the steel pipe is heated until the external surface temperature thereof reaches a predetermined temperature T1 that is not lower than "A3 transformation point+20° C." and not higher than 980° C. The reason why the steel pipe is heated until the external surface temperature thereof reaches a temperature not lower than "A3 transformation point+20° C." is that the steel pipe material is completely transformed to an austenitic structure. On the other hand, the reason why the steel pipe is heated until the external surface temperature thereof reaches a temperature not higher than 980° C. is that if the steel pipe is heated until the external surface temperature thereof reaches a temperature exceeding 980° C., the grains of the steel pipe material are coarsened, and therefore the toughness of steel pipe decreases. The reason for this is also that the nature of oxide scale formed on the steel pipe surface is degraded, which exerts an adverse influence at the time of inspection.

The above-described heating step may be performed by carrying the steel pipe in an appropriate heating furnace. Also, to control the external surface temperature of steel pipe to the predetermined temperature T1, the furnace temperature in the heating furnace may be set to the temperature T1.

The first cooling step is a step in which the steel pipe heated in the heating step is water cooled until the external surface temperature thereof reaches a predetermined temperature T2 not lower than 350° C. The reason why the lower limit value of the external surface temperature in the first cooling step is set to the predetermined temperature T2 not lower than 350° C. is that if the steel pipe is water cooled (cooled at a cooling rate not lower than about 2° C./sec) when the steel pipe has a temperature near Ms point (a temperature at which martensitic transformation of steel pipe material starts: about 330° C.), quenching cracks develop on the steel pipe.

The above-described first cooling step may be performed by using a shower-type water cooling apparatus or the like that sprays cooling water toward the external surface of steel pipe. The above-described first cooling step may also be performed by using a descaler for removing scale on the external surface of steel pipe in place of or in addition to the shower-type water cooling apparatus. Also, to control the external surface temperature of steel pipe to the predetermined temperature T2, for example, a radiation thermometer may be installed in the water cooling apparatus or on the outlet side of the water cooling apparatus, and cooling water may be sprayed until the external surface temperature of steel pipe measured by this radiation thermometer reaches the predetermined temperature T2.

The second cooling step is a step in which the steel pipe water cooled in the first cooling step is air cooled (for example, cooled at a cooling rate lower than 1° C./sec) until the external surface temperature thereof reaches a predetermined temperature T3 not higher than 250° C. The reason why the lower limit value of the external surface temperature in the second cooling step is set to not higher than 250° C. is that in the case where water cooling is selected in the successive third cooling step, the development of quenching cracks on the steel pipe caused by water cooling at a temperature near the aforementioned Ms point is avoided reliably.

The above-described second cooling step may be performed by using an air cooling apparatus equipped with a nozzle or the like for spraying air toward the external surface and/or the internal surface of steel pipe. Alternatively, the steel pipe may be allowed to cool naturally without the use of the air cooling apparatus. Also, to control the external surface temperature of steel pipe to the predetermined temperature T3 not higher than 250° C., for example, a radiation thermometer can be installed in the air cooling apparatus or on the outlet side of the air cooling apparatus, and air may be sprayed until the external surface temperature of steel pipe measured by this radiation thermometer reaches the predetermined temperature T3.

The third cooling step is a step in which the steel pipe air cooled in the second cooling step is water cooled or air cooled until the external surface temperature thereof reaches normal temperature. As described above, in the second cooling step, the steel pipe is cooled until the external surface temperature thereof reaches the predetermined temperature T3 not higher than 250° C., so that quenching cracks could not be developed on the steel pipe. Therefore, water cooling is preferably performed to reduce the cooling time.

In the case where water cooling is performed in the third cooling step, the water cooling apparatus or the like that is the same as that used in the first cooling step may be used. On the other hand, in the case where air cooling is performed in the third cooling step, the air cooling apparatus or the like that is the same as that used in the second cooling step may be used, or needless to say, the cooling time of the second cooling step may be prolonged in place of the execution of the third cooling step. Also, to control the external surface temperature of steel pipe to normal temperature, for example, a radiation thermometer can be installed in the water cooling apparatus (or the air cooling apparatus) or on the outlet side of the water cooling apparatus (or the air cooling apparatus), and cooling water (or air) may be sprayed until the external surface temperature of steel pipe measured by this radiation thermometer reaches normal temperature.

In the manufacturing method in accordance with the present invention, the cooling rate in the first cooling step is determined according to the wall thickness of the steel pipe so that the amount of heat recuperation, δT (refer to FIG. 1B) of the external surface temperature of steel pipe in the second cooling step explained above is 50° C. or smaller.

In the case of comparative example shown in FIG. 1A, the cooling rate in the first cooling step is higher than that of the present invention, so that time t1' taken for the external surface temperature of steel pipe to change from T1 to T2 is shorter than time t1 in the case of present invention. However, in the case of comparative example, since the cooling rate in the first cooling step is high, a difference in temperature between the internal and external surfaces of steel pipe immediately after the finish of the first cooling step becomes large, so that the amount of heat recuperation, δT exceeds 50° C. Therefore, time t2' taken for the external surface temperature of steel pipe to reach the predetermined temperature T3 not higher than 250° C. in the second cooling step is longer than time t2 in the case of present invention.

Since the cooling rate of water cooling in the first cooling step is far higher than the cooling rate of air cooling in the second cooling step, as shown in FIG. 1A, cooling time (t2'−t2) of air cooling reduced by decreasing the amount of heat recuperation is far longer than the cooling time (t1−t1') of water cooling reduced by increasing the cooling rate in the first cooling step. Therefore, as in the present invention, the cooling rate in the first cooling step is determined so that the amount of heat recuperation, δT, is 50° C. or smaller, and the cooling time in the second cooling step is reduced significantly, whereby the time required for the whole of cooling step (the first cooling step, the second cooling step, and the third cooling step) can be reduced as compared with comparative example. That is to say, the relationship of (t1+t2+t3)<(t1'+t2'+t3') can hold.

Since the amount of heat recuperation, δT, also depends on the wall thickness of steel pipe, the cooling rate in the first cooling step may be determined according to the wall thickness of steel pipe as described above.

The cooling rate in the first cooling step may be controlled by, for example, regulating water amount per unit time of cooling water sprayed from the aforementioned water cooling apparatus or the like. Also, the amount of heat recuperation, δT, in the second cooling step may be measured, for example, by installing a radiation thermometer in the aforementioned air cooling apparatus and by detecting a change amount (an amount of change from immediately after the start of air cooling) of the external surface temperature of steel pipe measured by the radiation thermometer. The water amount per unit time in the first cooling step may be regulated so that the measured amount of heat recuperation, δT, is 50° C. or smaller.

As described above, according to the manufacturing method in accordance with the present invention, since the cooling time (time required for performing the first to third cooling steps: t1+t2+t3) at the quenching time is reduced, the martensitic stainless steel pipe can be manufactured with high efficiency.

EXAMPLES

Hereunder, the features of the present invention are further clarified by showing examples.

Quenching tests were carried out on steel pipes having an outside diameter of 180 mm and wall thicknesses of 5 mm, 10 mm, and 15 mm. Specifically, the steel pipe having the above-described dimensions and containing the components given in Table 1 was heated until the external surface temperature thereof reached 950° C. (corresponding to the heating step of the present invention), and the heated steel pipe was water cooled until the external surface temperature thereof reached a predetermined temperature not lower than 350° C. (target temperature: 500° C.) (corresponding to the first cooling step of the present invention). Successively, the water cooled steel pipe was air cooled until the external surface temperature thereof reached a predetermined temperature not higher than 250° C. (target temperature: 200° C.) (corresponding to the second cooling step of the present invention), and further was water cooled until the external surface temperature thereof reached normal temperature (corresponding to the third cooling step of the present invention).

TABLE 1

| element | C | Si | Mn | P | S | Cr | Al | Ca |
|---|---|---|---|---|---|---|---|---|
| mass % | 0.180 | 0.310 | 0.400 | 0.018 | 0.0026 | 12.58 | 0.0008 | 0.0006 |
| element | Mo | Ni | V | Ti | Nb | N | B | |
| mass % | 0.000 | 0.11 | 0.070 | 0.000 | 0.000 | 0.0304 | 0.000 | |

In the first cooling step, the steel pipe was first cooled until the external surface temperature thereof lowered from 950° C. to 850° C. by using a descaler, and successively was cooled by using a shower-type water cooling apparatus that sprayed cooling water toward the external surface of steel pipe until the external surface temperature thereof reached the predetermined temperature not lower than 350° C. (target temperature: 500° C.). At this time, by regulating the water amount per unit time of cooling water sprayed from the water cooling apparatus, the cooling rate was changed to various values. Also, the second cooling step was performed by using an air cooling apparatus equipped with a nozzle or the like for spraying air toward the external and internal surfaces of steel pipe. Further, the third cooling step was performed by using the shower-type water cooling apparatus that was the same as that used in the first cooling step.

A radiation thermometer was installed on the outlet side of the water cooling apparatus used in the first cooling step, and the external surface temperature of steel pipe immediately after the finish of water cooling (at the start of air cooling) was measured. Also, the external surface temperature of steel pipe was measured by using a portable radiation thermometer while the second cooling step was performed, and a change amount of the measured external surface temperature was detected, whereby the amount of heat recuperation for the external surface temperature was measured.

On the other hand, in parallel with the above-described quenching test, the internal and external surface temperatures of steel pipe immediately after the finish of the first cooling step were calculated by numerical simulation based on heat transfer calculation. Specifically, a temperature change amount ΔT per unit time of the internal and external surface temperatures of steel pipe was calculated based on Equation (1) described below, and by time integrating this temperature change amount ΔT for the cooling time of the first cooling step, the internal surface temperature at the time when the external surface temperature of steel pipe lowered from 850° C. to 500° C. was calculated.

$$\Delta T = t_w + \{(t_m - t_w) \times (\lambda/\alpha_g)/(\lambda/\alpha_g - \Delta X/2)\} \quad (1)$$

where ΔT is temperature change amount per unit time, $t_w$ is the water temperature of cooling water, $t_m$ is the temperature of steel pipe, λ is the thermal conductivity of steel pipe, $\alpha_g$ is the heat transfer coefficient (for the external surface, heat transfer coefficient between water and steel pipe, and for the internal surface, heat transfer coefficient between air and steel pipe), and ΔX is the unit thickness of steel pipe.

The internal and external surface temperatures of steel pipe are influenced by the temperature distribution along the wall thickness direction of steel pipe as given by Equation (2) described below.

$$t_{mx} = \{t_{m(X-\Delta X/2)} + t_{m(X+\Delta X/2)}\}/2 \quad (2)$$

where $t_{mx}$ is the temperature of steel pipe in a position at a distance X from the surface (the internal surface or the external surface) of steel pipe along the wall thickness direction.

Therefore, the surface (internal surface or external surface) temperature of steel pipe calculated by the numerical simulation was set to an intermediate value between the surface (internal surface or external surface) temperature of steel pipe obtained by time integral of Equation (1) and the temperature of a middle part of wall thickness at a distance ΔX from the surface along the wall thickness direction.

The heat transfer coefficient (heat transfer coefficient of the external surface of steel pipe) $\alpha_g$ given in Equation (1) is a value determined by the water amount per unit time of cooling water and the temperature of steel pipe. Therefore, in the numerical simulation, the heat transfer coefficient $\alpha_g$ was changed according to the water amount per unit time of cooling water set at the time of the aforementioned quenching test.

FIG. 2 is a table showing the results of a quenching test and numerical simulation explained above. The "cooling time" and "cooling rate" shown in FIG. 2 mean cooling time and cooling rate, respectively, at the time when the shower-type water cooling apparatus is used in the first cooling step. Also, the "external surface temperature" and "internal surface temperature" mean the external surface temperature and internal surface temperature of steel pipe immediately after the finish of the first cooling step. Also, the "total cooling time" means cooling time required for the whole of cooling step (the first, second and third cooling steps). Further, in the "evaluation" shown in FIG. 2, the case where total cooling time of 1.3 times or more of the total cooling time required when the amount of heat recuperation in the second cooling step is assumed to be 0° C. was required was evaluated as "NA", and the case where total cooling time of less than 1.3 times was required was evaluated as "G".

As shown in FIG. 2, it could be proved that if the cooling rate of water cooling is determined so that the amount of heat recuperation is 50° C. or smaller (test Nos. 1 to 6, 9 and 10), the cooling time required for the whole of cooling step can be reduced. Also, it could be proved that the cooling rate necessary for making the amount of heat recuperation 50° C. or smaller differs according to the wall thickness of steel pipe even if the amount of heat recuperation is approximately equal (for example, even if the amount of heat recuperation is equal, being 47° C., the cooling rate (actually measured value) is 59° C./sec for test No. 4, whereas it is 14° C./sec for test No. 10). Therefore, it is found that the cooling rate of steel pipe in the first cooling step must be determined according to the wall thickness of steel pipe. Further, from the result of numerical simulation, it was found that, in order to obtain the amount of heat recuperation of 50° C. or smaller, the difference in temperature between the internal and external surfaces of steel pipe immediately after the finish of the first cooling step must be about 100° C. or smaller.

The invention claimed is:

1. A method for manufacturing a martensitic stainless steel pipe or tube, having a heat treatment step comprising:

a heating step of heating the steel pipe or tube until the external surface temperature thereof reaches a selected temperature not lower than A3 transformation point+20° C. and not higher than 980° C.;

a first cooling step of water cooling the heated steel pipe or tube until the external surface temperature thereof reaches a selected temperature not lower than 350° C.;

a second cooling step of air cooling the water cooled steel pipe or tube until the external surface temperature thereof reaches a selected temperature not higher than 250° C.; and a third cooling step of water cooling or air cooling the air cooled steel pipe or tube until the external surface temperature thereof reaches normal temperature, wherein the cooling rate of the steel pipe or tube in the first cooling step is determined according to the wall thickness of the steel pipe or tube so that the amount of heat recuperation for the external surface temperature of the steel pipe or tube in the second cooling step is not higher than 50° C.

* * * * *